US006979375B2

(12) United States Patent
Furuta et al.

(10) Patent No.: US 6,979,375 B2
(45) Date of Patent: Dec. 27, 2005

(54) TITANIUM ALLOY MEMBER

(75) Inventors: Tadahiko Furuta, Aichi (JP); Yoshiki Seno, Aichi (JP); JungHwan Hwang, Aichi (JP); Kazuaki Nishino, Aichi (JP); Takashi Saito, Aichi (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 10/019,283

(22) PCT Filed: May 1, 2001

(86) PCT No.: PCT/JP01/03786

§ 371 (c)(1),
(2), (4) Date: Jan. 2, 2002

(87) PCT Pub. No.: WO01/83838

PCT Pub. Date: Nov. 8, 2001

(65) Prior Publication Data

US 2003/0102062 A1 Jun. 5, 2003

(51) Int. Cl.[7] ..... C22C 14/00

(52) U.S. Cl. ..... 148/421; 148/670; 148/671; 420/417; 420/418; 420/419; 420/420; 420/421; 420/422

(58) Field of Search ..... 148/659, 670, 148/671, 421; 420/417, 418, 419, 420, 421, 422

(56) References Cited

U.S. PATENT DOCUMENTS

| | | | |
|---|---|---|---|
| 5,573,401 | A | 11/1996 | Davidson et al. |
| 5,871,595 | A | 2/1999 | Ahmed et al. |

FOREIGN PATENT DOCUMENTS

| | | |
|---|---|---|
| DE | 199 35 935 | 2/2000 |
| EP | 707085 | 4/1996 |
| EP | 1 046 722 | 10/2000 |
| EP | 1 114 876 | 7/2001 |
| JP | 52-147511 | 12/1977 |
| JP | 60-234934 | 11/1985 |
| JP | 61-157652 | 7/1986 |
| JP | 62-287028 | 12/1987 |
| JP | 2-163334 | 6/1990 |
| JP | 03-010038 | 1/1991 |
| JP | 6-73475 | 3/1994 |
| JP | 6-233811 | 8/1994 |
| JP | 8-299428 | 11/1996 |
| JP | 10-501719 | 2/1998 |
| JP | 10-219375 | 8/1998 |

OTHER PUBLICATIONS

A Dictionary of Metallurgy, by A. D. Merriman, 1958, p. 392.*

M. Morinaga, et al., Nippon Kinzoku Gakkai Kaihou, vol. 31, No. 7, pp. 599–603, "Bunshi Kido Riron Ni Yoru Goukin Sekkei", Jul. 20, 1992.

Derwent Publications, M. Morinaga, et al., An 11–341, XP–002234733, "Alloy Design Based on Molecular Orbital Method", Aug. 28–31, 1990.

* cited by examiner

*Primary Examiner*—John P. Sheehan
(74) *Attorney, Agent, or Firm*—Oblon, Spivak, McClelland, Maier & Neustadt, P.C.

(57) ABSTRACT

A titanium alloy member is characterized in that it comprise 40% by weight or more titanium (Ti), a IVa group element and/or a Va group element other than the titanium, wherein a summed amount including the IVa group element and/or the Va group element as well as the titanium is 90% by weight or more, and one or more members made in an amount of from 0.2 to 2.0% by weight and selected from an interstitial element group consisting of oxygen, nitrogen and carbon, and that its basic structure is a body-centered tetragonal crystal or a body-centered cubic crystal in which a ratio (c/a) of a distance between atoms on the c-axis with respect to a distance between atoms on the a-axis falls in a range of from 0.9 to 1.1. This titanium alloy member has such working properties that conventional titanium alloys do not have, is flexible, exhibits a high strength, and can be utilized in a variety of products.

13 Claims, 9 Drawing Sheets

Titanium Alloy of Present Invention

Measurement of Polar Figure by Schlutz's Reflection Method

1 Scale:1,000cps (110) Polar Figure Obtained in Sample No. 1

(110) Polar Figure Obtained in Sample No. 4

(110) Polar Figure Obtained in Sample No. 5

1 Scale:500cps (110) Polar Figure Obtained in Sample No. 2

1 Scale:1,000cps (110) Polar Figure Obtained in Sample No. 3

(110) Polar Figure Obtained in Comparative Sample

Definition of "w" Constituting Weighting Function "W" (Only 3 examples are shown.)

TEM Observation Result on Sample No. 1
(Bright Field Image)

TEM Observation Result on Sample No. 1'
(Bright Field Image)

TEM Observation Result in Sample No. 1
Electron Diffraction Pattern and Dark Field
Image Using 110 Diffraction Point
Value read by goniometer was -16.3°.

TEM Observation Result in Sample No. 1
Electron Diffraction Pattern and Dark Field
Image Using 110 Diffraction Point
Value read by goniometer was 6.1°.

Titanium Alloy of Present Invention

Conventional Titanium Alloy

TITANIUM ALLOY MEMBER

TECHNICAL FIELD

The present invention relates to a titanium alloy member, which can be utilized in a variety of products in every field and which is good in terms of the cold working property. Moreover, the present invention relates to a production process, which can efficiently produce the titanium alloy member.

BACKGROUND ART

Since titanium alloy is light-weight and exhibits a high strength (since it exhibits a large specific strength), it has been used in the fields of aviation, military, ocean, space, and the like. However, since titanium alloy is usually poor in terms of the working property and forming property, the material yield has been poor and accordingly titanium products has been expensive in general. Therefore, its usage range has been limited.

Recently, a titanium alloy (for example, Ti-22V-4Al: a trade name "DAT51," etc.), which is relatively good in terms of the working property, titanium products have been increasing around us. However, it has not been possible yet to say that the working property is sufficient, and, when a working ratio enlarges, there often arises a case where the ductility lowers sharply. Therefore, when a titanium alloy, which is good in terms of the working property, is available, the material yield of titanium products is improved, and accordingly it is possible to intend the increment of production volume, the further expansion of usage, and the like.

Moreover, in order to intend the usage expansion of titanium products, in addition to such a working property, a titanium alloy, which exhibits a low Young's modulus and a high strength, has been required. When such a titanium alloy is available, the degree of designing freedom of a variety of products is sharply upgraded to such an extent that cannot be achieved by conventional materials. For instance, when a titanium alloy, which exhibits a low Young's modulus and a high strength, is used in the heads of golf clubs, it is possible to reduce the natural frequencies at the face portions, and accordingly it is possible to synchronize the natural frequencies at the face portions with the natural frequencies of golf balls. Thus, it is said that it is possible to obtain golf clubs, which can remarkably extend the driving distance of golf balls. In addition, for example, when a titanium alloy, which exhibits a low Young's modulus and a high strength, is used in the frames (especially the temple portions) of eyeglasses, a superb fitting feeling is available, and, together with the light-weightness, allergic resistance, and so on, it is said that the functional properties are greatly enhanced.

Thus, when a titanium alloy, which is provided with not only a superb working property but also a low Young's modulus as well as a high strength, is developed, it is believed that the demand of titanium alloy members (titanium products), which use it, expands more and more.

DISCLOSURE OF INVENTION

The present invention has been developed in view of such circumstances, and it is therefore an object of the present invention to provide a titanium alloy member, which is provided with a superb working property, a low Young's modulus and a high strength which cannot be achieved by conventional titanium alloys.

The present inventors have been studying earnestly in order to solve this assignment, have been carrying out a variety of systematic experiments repeatedly, as a result, have discovered a completely new titanium alloy, which can satisfy those requirements and which has not been available conventionally, and have completed the present invention.

Titanium Alloy Member

(1) Titanium Alloy Member in View of Texture

The present inventors, first of all, have discovered that such a titanium alloy has a special texture, and have arrived at the development of a titanium alloy member according to the present invention.

Namely, a titanium alloy member according to the present invention is characterized in that it comprises 40% by weight or more titanium (Ti), a IVa group element and/or a Va group element other than the titanium, wherein a summed amount including the IVa group element and/or the Va group element as well as the titanium is 90% by weight or more;

it comprises grains which are a body-centered tetragonal crystal or a body-centered cubic crystal in which a ratio (c/a) of a distance between atoms on the c-axis with respect to a distance between atoms on the a-axis falls in a range of from 0.9 to 1.1; and it has a texture, when a polar figure of the (110) or (101) crystal plane of the grains is measured parallelly to a plane, which involves a working direction, in ranges of $20°<\alpha'<90°$ and $0°<\beta<360°$ by the Schlutz's reflection method, and when the respective measurement values (X), which distribute equally on the polar figure, are processed statistically, texture in which a value ($\nu 2/Xm^2$), which is obtained by dividing a secondary moment ($\nu 2$) around a mean value (Xm), being defined by the following equation, with a square of the mean value ($Xm^2$), is 0.3 or more, a value ($\nu 3/Xm^3$), which is obtained by dividing a tertiary moment ($\nu 3$) around the mean value (Xm), being defined by the following equation, with a cube of the mean value ($Xm^3$), is 0.3 or more, and values (1.6Xm), which are 1.6 times or more of the mean value, are further involved in measurement values, which are measured in a range of $55°<\alpha'<65°$ and in the range of $\beta$ along the working direction;

$$\text{Secondary Moment: } \nu 2=\{\Sigma(X-Xm)^2\}/N$$

$$\text{Tertiary Moment: } \nu 3=\{\Sigma(X-Xm)^3\}/N$$

(Note that N is a number of samplings.).

This titanium alloy member, from the compositional viewpoint, it comprises titanium, a IVa group element and/or a Va group element, from the crystal structural viewpoint, is substantially a body-centered cubic crystal, from the metallographic viewpoint, has a special texture, which has not been available in the conventional $\beta$ titanium alloy, and the like.

The present inventors discovered that such a titanium alloy member is good in terms of the working properties, especially in terms of the cold working property, and that it is provided with such a characteristic that it exhibits a low Young's modulus and a high strength.

At present, in a case where a titanium alloy member has such a texture, or the like, it has not necessarily been clear yet why it is improved in terms of the cold working property and comes to exhibit a low Young's modulus and a high strength.

By the way, a "titanium alloy member," set forth in the present description, involves both of a titanium alloy and worked members, which are made by subjecting the titanium alloy to certain working. The forms of the worked members can be workpieces, such as plate members, wire members, etc., intermediate members or intermediate products, which are made by working the workpieces, etc., and further final products, which were made by working the intermediate members, etc. In any way, the extent of working does not matter at all. In the working, in addition to cold working, hot working is involved as well.

Concerning the composition of the above-described titanium alloy member, titanium is comprised in an amount of 40% by weight or more, and the sum of the IVa group element and/or the Va group element as well as the titanium is made 90% by weight or more in order to simultaneously achieve a good cold working property and a low Young's modulus.

It is further preferred that titanium is comprised in an amount of 45% by weight or more, and that the sum of the IVa group element and/or the Va group element as well as the titanium is made 95% by weight or more.

Note that the IVa group element and/or the Va group element are not limited in particular as far as they are the elements of the respective groups. In the IVa group element, there are zirconium (Zr) and hafnium (Hf), in the Va group element, there are niobium (Nb), tantalum (Ta) and vanadium (V). It is suitable to appropriately carry out the selection from the viewpoints of the specific weight and raw material cost.

The crystal structure is made into a body-centered tetragonal crystal or body-centered cubic structure whose "c/a" falls in a range of from 0.9 to 1.1, however, it is not necessarily required to strictly distinguish between the two. It is sufficient that it has a structure which is considered a body-centered cubic crystal substantially.

(2) Titanium Alloy Member in View of Specific Composition

Next, the present inventors ascertained that the above-described titanium alloy member, which is provided with a good working property and a low Young's modulus, is composed of specific compositions, which satisfy specific parameters, by carrying out an enormous number of experiments, and completed the present invention.

Namely, a titanium alloy member according to the present invention is characterized in that it comprises titanium and an alloying element; and it has a specific composition in which a compositional mean value of substitutional elements is $2.43<Md<2.49$ with regard to the energy level "Md" of the d-electron orbit and a compositional mean value of the substitutional elements is $2.86<Bo<2.90$ with regard to the bond order "Bo", the "Md" and the "Bo" each being a parameter obtained by the "DV-Xα" cluster method.

At present, the detailed arising mechanism, and the like, have not been clear yet, however, when a titanium alloy member is composed of the specific composition which falls in the aforementioned extremely limited ranges of $2.43<Md<2.49$ and $2.86<Bo<2.90$, it was understood that it shows the above-described good characteristics.

(3) Titanium Alloy Member in View of Dislocation Density

Moreover, the present inventors discovered that the titanium alloy member (especially, cold-worked members), which is provided with the above-described good working properties, low Young's modulus or high strength, hardly had dislocation (linear lattice defect) inside the crystals, and completed the present invention.

Namely, a titanium alloy member according to the present invention is characterized in that it exhibits a dislocation density of $10^{11}/cm^2$ or less when cold working is carried out by 50% or more.

Conventionally, the plastic deformation of metal has been explained as slip deformation or twin-crystal deformation. In particular, in the conventional β-titanium alloys, the slip deformation is predominant, and this slip deformation has been explained by the movement of the aforementioned dislocation. The more the cold working ratio increases the more the dislocation increases, and accordingly there arises work hardening in general. Consequently, when the conventional titanium alloy materials are subjected to cold working with a large working ratio without carrying out intermediate annealing, etc., there often occur cracks, and the like.

However, in the case of the titanium alloy member according to the present invention, even if it is not subjected to a heat treatment, and so on, it is possible to repeatedly subject it to cold working, even when the cold working ratio enlarges, there occur no cracks, and the like. At present, the reason has not been certain yet, however, in view of the aforementioned dislocation density, it is possible to believe that the plastic deformation arises by a mechanism which is different from those of the conventional metallic materials.

Anyway, since the titanium alloy member according to the present invention is remarkably good in terms of the cold working property, it is effective to improve the (material) yield of the titanium alloy member as well as the productivity, moreover, it can be applied to a variety of products and expand the degree of freedom in their designing.

(4) Production Process of Titanium Alloy Member

The present inventors has developed, along with the above-described titanium alloy member, a process, which can efficiently produce it, as well.

Namely, a process for producing a titanium alloy member according to the present invention is characterized in that it comprises: preparing step of preparing a raw material, the raw material comprising titanium and an alloying element, and having a specific composition in which a compositional mean value of substitutional elements is $2.43<Md<2.49$ with regard to the energy level "Md" of the d-electron orbit and a compositional mean value of the substitutional elements is $2.86<Bo<2.90$ with regard to the bond order "Bo", the "Md" and the "Bo" each being a parameter obtained by the "DV-Xα" cluster method; and member forming step of forming a titanium alloy member comprising the raw material after the preparing step.

In accordance with the preparing step of the present invention, the composition of a titanium alloy member, which shows the above-described good working properties, high strength or low Young's modulus, can be specified with ease, and the titanium alloy member can be securely and efficiently produced.

Note that a "high strength" set forth in the present description designates that a tensile strength or a tensile elastic limit strength, which will be described later, is large. Moreover, a "low Young's modulus" designates that a mean Young's modulus, which will be described later, is small with respect to the Young's moduli of the conventional metallic materials.

BEST MODE FOR CARRYING OUT THE INVENTION

A. Mode for Carrying Out

Hereinafter, while giving modes for carrying out, the titanium alloy member according to the present invention will be described in detail.

Note that it is possible to selectively and appropriately combine the respective constituent elements of the above-described titanium alloy member comprising the aforementioned texture, titanium alloy member exhibiting the dislocation density, titanium alloy member having the composition specified by the energy level of the d-electron orbit the bond order and the titanium alloy member production process between the respective titanium alloy members or between them and the production process. Moreover, it is notified that, regarding respective limiting elements, which will be described later, as well, it is possible to selectively combine the respective constituent elements of those titanium alloy members and the production process appropriately with each other.

(1) Texture

The texture is a deformed texture which is made when polycrystals are subjected to (strong) working and in which the respective crystals have priority orientations. In this texture, in addition to worked textures, recrystallized textures, etc., are involved which are made when worked textures are recrystallized.

Figure 1:
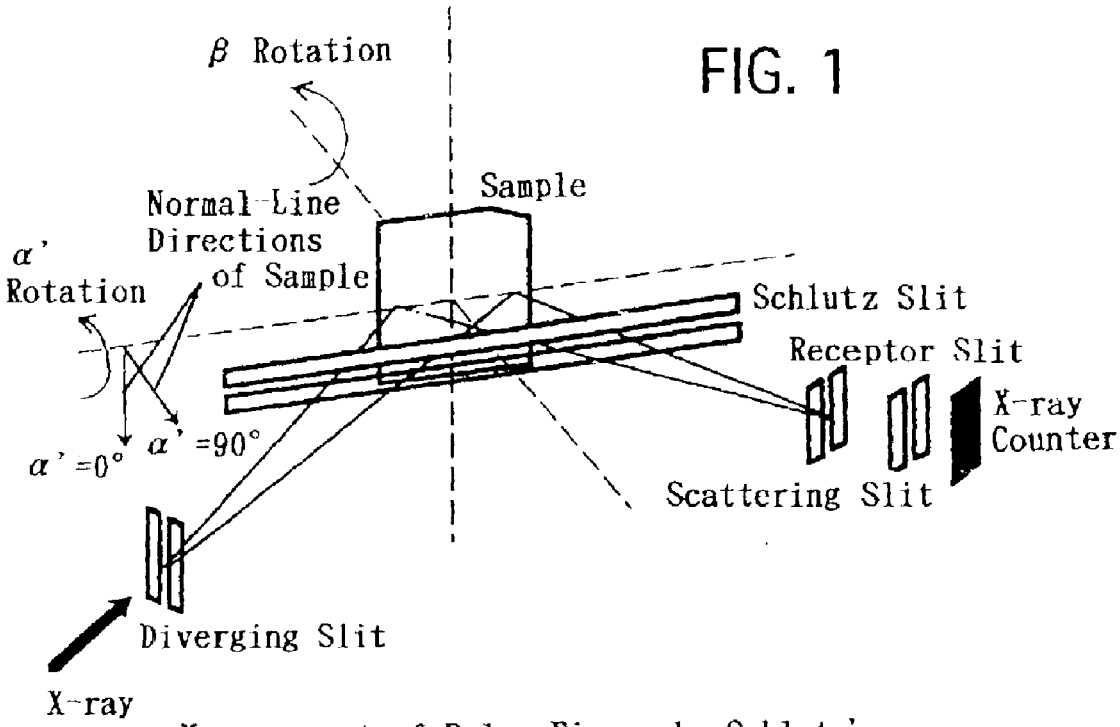
FIG. 1 is a schematic diagram for illustrating an outline of the measuring method of a polar figure by the Schlutz's reflection method.

The measurement of this texture is done by a variety of methods, however, the state of the texture was herein clarified from a polar figure which was obtained by the stereoscopic projection by using the general Schlutz's reflection method. The outline of the measurement method of the polar figure by this Schlutz's reflection method is shown in FIG. 1.

Moreover, the respective measurement values on the polar figure were processed statistically and the values ($\nu 2/Xm^2$, $\nu 3/Xm^3$), which were obtained by dividing the secondary or tertiary moment ($\nu 2$, $\nu 3$) around the mean value (Xm) respectively with the square or cubic ($Xm^2$, $Xm^3$) of the mean value, were used in order make objective comparison with the other materials easy.

Here, the $\nu 2/Xm^2$ shows the deviation of the measurement values. When the $\nu 2/Xm^2$ is less than 0.3, it designates that the deviation of the (110) plane or (101) plane in the polar figure is not large, and the elastic anisotropy is not sufficient and it is not preferable.

Moreover, in a case where the $\nu 3/Xm^3$ is such that it is large in a range of positive number, it designates that the measurement values protrude in a range larger than the mean value (Xm). When the $\nu 3/Xm^3$ is less than 0.3, it means that the concentration in the specific portions of the (110) plane or (101) plane in the polar figure is not large, the elastic anisotropy, which is possessed by a material, is not sufficient and it is not preferable.

On the other hand, when the $\nu 2/Xm^2$ is 0.3 or more and when the $\nu 3/Xm^3$ is 0.3 or more, the deviation of the (110) plane or (101) plane is sufficiently large and the concentration is sufficient in the specific portions, and it is believed to be a preferable material which exhibits a sufficiently large elastic anisotropy. When the $\nu 2/Xm^2$ is 0.4 or more, 0.5 or more or 0.6 or more and when the $\nu 3/Xm^3$ is 0.4 or more, 0.5 or more or 0.6 or more, it is more preferable.

The titanium alloy member according to the present invention is characterized in that this portion, in which the (110) plane or (101) plane is concentrated, is restricted in a part of the polar figure, and it is possible to believe that this reflects the "anisotropic" character of the elastic anisotropy of this titanium alloy member.

In particular, when "values (1.6Xm), which are 1.6 times or more of the mean value," are further involved "in measurement values, which are measured in a range of $55° < \alpha' < 65°$ and in the range of $\beta$ along the working direction," it is possible to judge it as a member which possesses a material characteristic having a favorable anisotropy. When there is a value which is 1.8 times or more of the mean value, further 2.5 times or more of the mean value, it is more desirable.

Note that, when the titanium alloy member has, in addition to such a texture, 50% or more of a cold-worked structure in which a dislocation density inside the grains is $10^{11}/cm^2$ or less, it is suitable because the Young's modulus is made much lower.

(2) Composition

① When the titanium alloy member according to the present invention includes an interstitial element, for instance, one or more elements of an interstitial element group, consisting of oxygen (O), nitrogen (N) and carbon (C), in a summed amount of from 0.25 to 2.0% by weight, it is suitable. Then, when the summed amount is made to fall in a range of from 0.3 to 1.8% by weight, further from 0.6 to 1.5% by weight, it is more preferable. In particular, when the summed amount is made to exceed 0.6% by weight and to be 2.0% by weight or less, 1.8% by weight or less or 1.5% by weight or less, it is much more preferable.

Oxygen, nitrogen and carbon are an interstitial element, and it is generally said that titanium alloy of high strength is obtained by solution reinforcement. Meanwhile, as the solving amount of those elements increases, it has been known that titanium alloy is embrittled. Hence, in a case of conventional titanium alloys, the included oxygen amount, etc., have been allowed to an extent of 0.25% by weight at the highest. In addition, in a case of titanium alloy, special attentions have been paid in order to control the oxygen amount, etc., within the range, and have resulted in a cause of raising up the manufacturing cost.

However, the present inventors disproved such a common sense, and discovered that, when the titanium alloy according to the present invention included an unprecedentedly large amount of O, N or C, it is remarkably tough and shows a high elastic deformation capability. This discovery is epoch-making in the industrial field of titanium alloy, and is very meaningful scientifically as well. The detailed reasons, and the like, have not been clear yet, but the present inventors are now earnestly investigating toward the clarification. Note that, in a case of the present titanium alloy member, since the characteristics are improved by the inclusion of oxygen, nitrogen or carbon in a large amount, the necessity for strictly controlling the oxygen content, etc., has been obviated. Therefore, such a characteristic of the present titanium alloy member is also preferable in view of improving the productivity as well as the economical efficiency.

In any case, it is needless to say that, when oxygen, nitrogen or carbon is too less, it is not possible to intend to strengthen the titanium alloy member sufficiently high, on the contrary, when those elements are too much, it results in the deterioration of the toughness and ductility of the titanium alloy member and is not preferable.

Note that the compositional range of the aforementioned respective elements is set forth in a form of "from 'x' to 'y'% by weight," unless otherwise specified, this includes the lower limit value (x) and upper limit value (y).

(3) Energy Level of d-Electron Orbit and Bond Order

The energy level of the d-electron orbit and the bond order are parameters which are inherent in substitutional elements being found by the DV-Xα cluster method.

The DV-Xα cluster method is one of electron orbital methods, and is a method which can ingeniously simulate local electronic states around alloying elements (Reference Literature; Introduction to Quantum Material Chemistry Written by ADACHI Hirohiko and Published by Sankyo Publishing Co., Ltd. (1991)).

Specifically, a model is prepared by using clusters (imaginary molecules in crystals) which correspond to respective crystal lattices, the central substitutional element "M" is changed, and the state of the chemical bond between "M" and a mother alloy "X" (In the present case, "X" is Ti.) is examined. Then, the DV-Xα cluster method is a method by which alloying parameters, expressing individualities which the "M" working as an alloying component shows in the mother alloy, are found. When it is limited to materials which are mainly composed of transition metals, two parameters, (a compositional mean value of) the energy level "Md" of the d-electron orbit and (a compositional mean value of) the bond order "Bo," are said to be effective in practice.

Note that the energy level "Md" of the d-electron orbit shows the energy level of the d-orbit of a substitutional element "M" and is a parameter which possesses a correlation with the electronegativity and atomic radius of an atom. The bond order "Bo" is a parameter which expresses a degree of overlapping electron clouds between a mother alloying element "X" and a substitutional element "M".

As described above, although the detailed reasons have not been clear yet, when the titanium alloy member according to the present invention is constituted from a plurality of elements which exhibit $2.43<Md<2.49$ and $2.86<Bo<2.90$, the above-described good characteristics are obtained.

Thus, it is more preferable to be $2.45<Md<2.48$, further $2.46<Md<2.47$, and to be $2.865<Bo<2.885$, further $2.87<Bo<2.88$.

Note that, as a specific composition satisfying these parameters, a titanium alloy is expected which comprises a Va element in an amount of from 20 to 50% by weight and the balance of titanium, for example. However, since the ranges of the aforementioned parameters are narrow, it is notified that all titanium alloys, which are involved in the compositional range, do not satisfy the aforementioned parameters.

Moreover, when the parameters are observed with reference to the above-described texture, if the "Md" value is 2.49 or more or the "Bo" value is 2.86 or less, the body-centered cubic crystal (bcc) or body-centered tetragonal crystal (bct) becomes instable. Then, since a part of the texture turns into a dense hexagonal crystal (hcp), the cold working property degrades. In addition, if the "Md" value is 2.43 or less or the "Bo" value is 2.90 or more, the bonding forces between atoms enlarge and result in the degradation of cold working property and the rise of Young's modulus.

(4) Cold Working and Dislocation Density

① "Cold" designates a recrystallization temperature (a minimum temperature which causes recrystallization) or less of titanium alloy. For instance, the cold working of 50% or more refers to a case where a cold working ratio, which is defined by the following equation, is 50% or more.

$$\text{Cold Working Ratio}=(S_0-S)/S_0\times 100(\%)$$

($S_0$: Cross-sectional Area before Cold Working, S: Cross-sectional Area after Cold Working)

Note that a structure, which is obtained when a titanium alloy (material) is cold-worked, is called a cold-worked structure in the present description.

② The dislocation density is a number of dislocations per a unit area, and, for instance, can be found by observing an internal deformed structure by utilizing the diffraction phenomenon of an electron beam or an x-ray.

As described above, when the titanium alloy member according to the present invention is subjected to cold working, it exhibits such a less dislocation density that it is difficult to observe by ordinary methods, and it is believed that the plastic deformation arises by an unknown mechanism which is different from those of conventional metallic materials. As a result, without causing cracks, etc., by working, it is possible to carry out (cold) working to a remarkable extent. Then, it is believed that, in accordance with the present titanium alloy member, it is possible to carry out plastic working even those having configurations, which have been difficult to form conventionally, with a good material yield by means of cold working.

It has been described so far with reference to the case where the cold working of 50% or more is performed, however, the extent of the cold working can even be 70% or more, further 90% or more, furthermore 99% or more. Then, the dislocation density can be $10^7/cm^2$ or less.

(5) Production Process

As described above, the production process according to the present invention comprises the preparing step and the member forming step.

The preparing step is a step in which a raw material is prepared by selecting and determining the kinds of the compositional elements and the contents of the respective elements so as to satisfy the above-described parameters "Md" and "Bo."

However, the raw material composition in this preparing step does not necessary agree completely with the elemental composition of a final titanium alloy member. This is because there can be alloying elements which are mingled or omitted in the subsequent member forming step, and so on. Therefore, in such a case, the raw material can be prepared so that the elemental composition of a final titanium alloy member satisfies the above-described $2.43<Md<2.49$ and $2.86<Bo<2.90$. Note that, as a substitutional element, there are niobium, tantalum, vanadium, zirconium, hafnium, and the like, for example, and it is suitable that the raw material can include at least one or more elements of those.

The member forming step can be either a melting method in which the raw material is first melted and a member is thereafter formed, or a sintering method in which a raw material powder is sintered.

For instance, in the case of a melting method, the member forming method can be an ingot manufacturing step in which an ingot member is manufactured from the aforementioned raw material, which has been undergone the aforementioned preparing step. This ingot manufacturing step can be realized by carrying out melting (a melting step) a titanium alloy by means of arc melting, plasma melting, induction scull, and so on, and casting (a casting step) the resulting molten titanium alloy into a mold, and the like.

Moreover, in the case of a sintering method, the aforementioned preparing step can be a powder preparing step in which a raw material powder making the aforementioned specific composition, and the aforementioned member forming step is a sintering step in which a sintered member is manufactured from the raw material powder which has undergone the powder preparing step.

The raw material powder, which is used in the powder preparing step, can be a titanium powder, a mixture powder which comprises powders of alloying elements or an alloy powder, or one kind of alloy powders which possess the aforementioned specific composition (or compositions close to the specific composition).

The sintering step can be carried out by filling a mixture in a mold for forming (a filling step), pressuring and forming the mixture powder into a formed body (a forming step) and heating the formed body to sinter (a heating step). Moreover, the forming step can be carried out by using a CIP (Cold Isostatic Press). In addition, the forming step and the heating step can be carried out by means of an HIP (Hot Isostatic Press).

Note that, in a case where titanium is melted, a special apparatus is needed, and that it is necessary to carry out multiplex melting, and so on. It is also difficult to control the composition in melting, in particular, in a case where a Va element, etc., is contained in a large amount, the macro component segregation is likely to take place in melting and casting. Therefore, in view of efficiently producing a stable-quality titanium alloy member, it is believed at present that a sintering method is more preferable. In any case, by a melting method as well, for example, by using a method, or the like, which will be described in later-described examples, it is possible to produce a sufficient-quality titanium alloy member.

Moreover, when a sintering method is used, it is possible to obtain a fine titanium alloy member, even if product configurations are complicated, it is possible to make net shapes.

② When the thus obtained aforementioned sintered member or ingot member is subjected to the aforementioned cold working, it is possible to make the resulting titanium alloy member exhibit a much higher strength and a much lower Young's modulus.

Hence, it is suitable that the production process according to the present invention can be provided with a cold working step in which the aforementioned sintered member or ingot member is cold-worked.

Moreover, a hot working step can be appropriately added. In particular, in the case of a sintered member, it is possible to density the structure by carrying out hot working. It is preferable to carry out this hot working step after the heating-and-sintering step and before the cold working step.

When the cold working step and the hot working step are carried out so as to comply with a desired configuration of a titanium alloy member, the productivity is further improved. Note that the cold working step and the hot working step can be considered being involved in the member forming step set forth in the present invention.

③ Moreover, the present inventors discovered that a high-strength titanium alloy member, which is good in terms of the later-described high elastic deformation capability, high tensile elastic limit strength, and so on, is obtained by performing an age-treatment step after the cold working step.

However, before performing an age-treatment step, a solution treatment step can be carried out at a recrystallizing temperature or more, but, since the influence of working strain, which is given within a titanium alloy by cold working, is lost, much higher characteristics are obtained by directly carrying out an age-treatment step after the cold working step.

In the age-treatment condition, there are (a) a low-temperature short-time age-treatment (from 150 to 300° C.) and (b) a high-temperature long-time age-treatment (from 300 to 600° C.), and the like.

In accordance with the former, while improving the tensile elastic limit strength, it is possible to maintain or lower the mean Young's modulus, and thereby a titanium alloy of high elastic deformation capability is obtained. In accordance with the latter, accompanied by the rising of the tensile elastic limit strength, the mean Young's modulus slightly rises, but the mean Young's modulus is nevertheless 95 GPa or less. Namely, even in this case, the rising level of the mean Young's modulus is very low, and thereby a titanium alloy is obtained which exhibits a high elastic deformation capability and a high tensile elastic limit strength.

Moreover, the present inventors found out by carrying out an enormous number of experiments that it is preferred that, at a treatment temperature falling in a range of from 150 to 600° C., the age-treatment step can be a step in which a parameter (P), which is determined with a treatment temperature ("T" ° C.) and a treatment time ("t" hours) based on the following equation, falls in a range of from 8.0 to 18.5.

$$P=(T+273)\cdot(20+\log_{10} t)/1000$$

This parameter "P" is a Larson-Miller parameter, is determined by a combination of a heat treatment temperature and a heat treatment time, and indexes the conditions of an age-treatment step (heat treatment).

When this parameter "P" is less than 8.0, even if the age-treatment is performed, favorable material characteristics are not obtained, when the parameter "P" exceeds 18.5, it results in the lowering of the tensile elastic limit strength, the rising of the mean Young's modulus or the lowering of the elastic deformation capability, and is not preferable.

Note that it is more suitable that the cold working step, which is carried out before this age-treatment step, can be one in which the cold working ratio is made 10% or more.

Then, according to desired characteristics of a titanium alloy member, the aforementioned age-treatment step can be made into a step in which the aforementioned treatment temperature falls in a range of from 150° C. to 300° C. and the aforementioned parameter "P" falls in a range of from 8.0 to 12.0 so that a titanium alloy member, which is obtained after this age-treatment step, exhibits a tensile elastic limit strength of 1,000 MPa or more, an elastic deformation capability of 2.0% or more and a mean Young's modulus of 75 GPa or less.

Moreover, the aforementioned age-treatment step can be, likewise, made into a step in which the aforementioned treatment temperature falls in a range of from 300° C. to 500° C. and the aforementioned parameter "P" falls in a range of from 12.0 to 14.5 so that a titanium alloy member, which is obtained after this age-treatment step, exhibits a tensile elastic limit strength of 1,400 MPa or more, an elastic deformation capability of 1.6% or more and a mean Young's modulus of 95 GPa or less.

Note that, in the present description, a numerical range of "from 'x' to 'y,'" unless otherwise specified, includes the lower limit value "x" and upper limit value "y."

(5) Tensile Elastic Limit Strength, Elastic Deformation Capability and Mean Young's Modulus An elastic limit strength is defined as a stress, which is applied when a permanent elongation (strain) reaches 0.2% in a tensile test. An elastic deformation capability is a deformation quantity of a test piece at this tensile elastic limit strength. A mean Young's modulus does not indicate a "mean" of a Young's modulus in a strict sense, but designates a Young's modulus which represents a titanium alloy member according to the present invention. Specifically, in the stress-strain diagram obtained in the aforementioned tensile test, it is a gradient of a curve (a gradient of a tangential line) at a stress position which corresponds to ½ of the aforementioned tensile elastic limit strength.

Incidentally, a tensile strength is, in the aforementioned tensile test, a stress which is found by dividing a load immediately before the final breakage of the test piece with a cross-sectional area at the parallel portion of the test piece before the test.

Hereinafter, a tensile elastic limit strength and an average Young's modulus, which are concerned with a titanium alloy member according the present invention, will be hereinafter described in detail as follows by using FIGS. 14A and 14B.

Figure 14A:
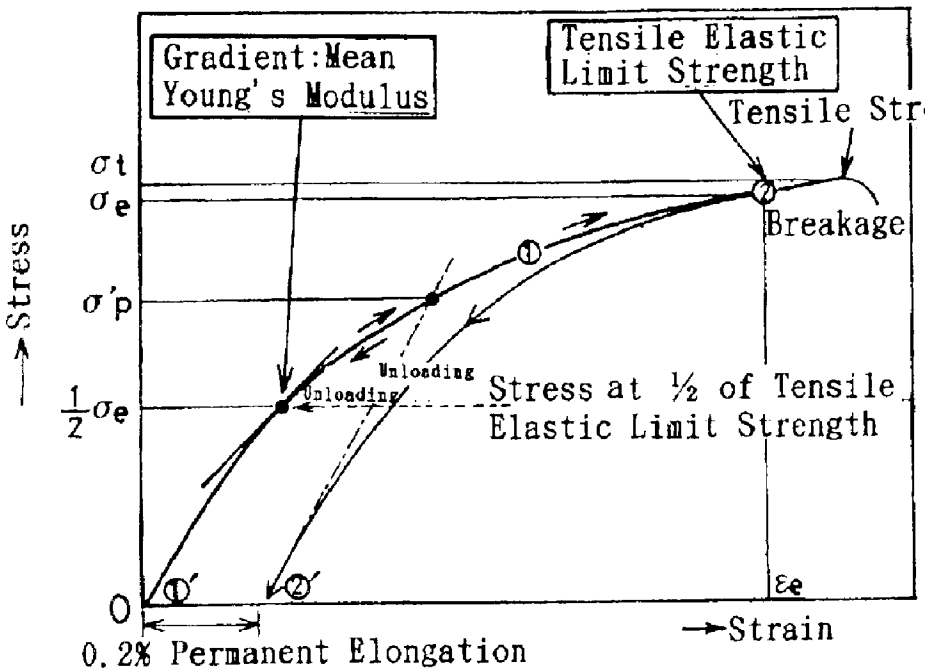
FIG. 14A is a diagram for schematically illustrating a stress-strain chart of a titanium alloy member concerning with the present invention.
Figure 14B:
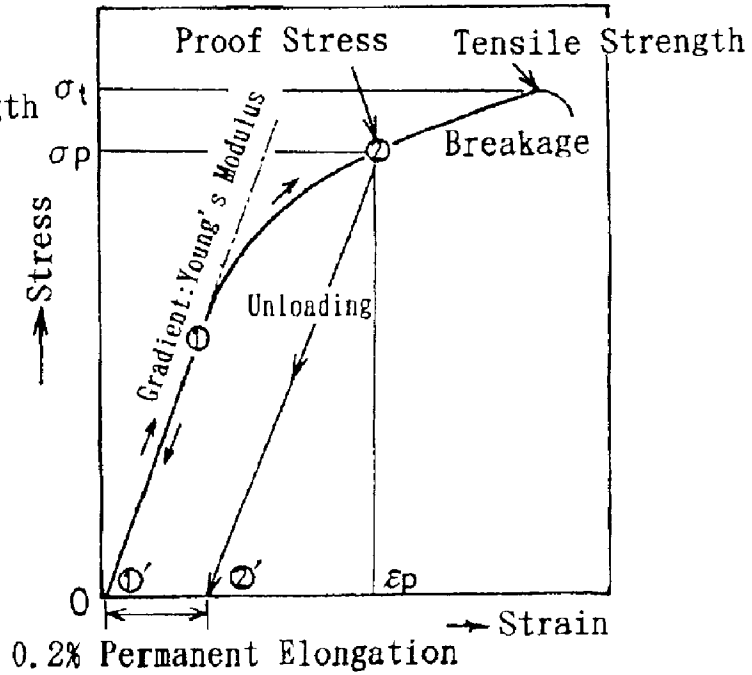
FIG. 14B is a diagram for schematically illustrating a stress-strain chart of a conventional titanium alloy.

FIG. 14A is a drawing, which schematically illustrates a stress-strain diagram of the titanium alloy member according to the present invention, and FIG. 14B is a drawing, which schematically illustrates a stress-strain diagram of a conventional titanium alloy (Ti-6Al-4V alloy).

① As illustrated in FIG. 14B, in the conventional metallic material, first of all, the elongation increases linearly in proportion to the increment of the tensile stress (between ①'–①). Then, the Young's modulus of the conventional metallic material is found by the gradient of the straight line. In other words, the Young's modulus is a value, which is found by dividing a tensile stress (nominal stress) with a strain (nominal strain), which is in a proportional relationship thereto.

In the straight line range (between ①'–①), in which the stress and the strain are thus in a proportional relationship, the deformation is elastic, for example, when the stress is unloaded, the elongation, being the deformation of a test piece, returns to 0. However, when a tensile stress is further applied beyond the straight line range, the conventional metallic material starts deforming plastically, even when the stress is unloaded, the elongation of the test piece does not return to 0, and there arises a permanent elongation.

Ordinarily, a stress "σp," at which a permanent elongation becomes 0.2%, is referred to as a 0.2% proof stress (JIS Z 2241). This 0.2% proof stress is, on the stress-strain diagram, also a stress at the intersection (position ②) between a straight line (②'–②), which is obtained by parallelly moving the straight line (①'–①: the tangential line of the rising portion) in the elastic deformation range by a 0.2% elongation (strain), and the stress-strain curve.

In the case of conventional metallic materials, ordinarily, it is believed that the 0.2% proof stress≈the tensile elastic limit strength based on the empirical rule "when the elongation exceeds by about 0.2%, it becomes the permanent elongation." Conversely, within the 0.2% proof stress, it is believed that the relationship between the stress and the strain is generally linear or elastic.

② However, as can be seen from the stress-strain diagram of FIG. 14A, such a conventional concept cannot be applied to a titanium alloy member according to the present invention. The reasons have not been clear, however, in the case of the present titanium alloy member, the stress-strain diagram does not become linear in the elastic deformation range, but it becomes an upwardly convexed curve (①'–②), when the stress is unloaded, the elongation returns to 0 along the same curve ①–①', or there arises a permanent elongation along ②–②'.

Thus, in the titanium alloy member according to the present invention, even in the elastic deformation range (①'–①), the stress and the strain is not in the linear relationship (namely, being non-linear), when the stress increases, the strain increases sharply. Moreover, it is the same in the case where the stress is unloaded, the stress and the strain are not in the linear relationship, when the stress decreases, the strain decreases sharply. These characteristics are believed to arise as the high elastic deformation capability of the present titanium alloy member.

By the way, in the case of the titanium alloy member according to the present invention, it is appreciated from FIG. 14A as well that the more the stress increases, the more the gradient of the tangential line on the stress-strain diagram decreases. Thus, in the elastic deformation range, since the stress and the strain do not change linearly, it is not appropriate to define the Young's modulus of the present titanium alloy member by the conventional method.

Moreover, in the case of the titanium alloy member according to the present invention, since the stress and the strain do not change linearly, it is not appropriate either to evaluate 0.2% proof stress (σp')≈tensile elastic limit strength by the same method as the conventional method. That is, the 0.2% proof stress, which is found by the conventional method, has become a remarkably smaller value than the inherent tensile elastic limit strength. Therefore, in the case of the present titanium alloy member, it is not possible to believe that 0.2% proof stress≈tensile elastic limit strength.

Therefore, by turning back to the original definition, a tensile elastic limit strength (σe) of the titanium alloy member according to the present invention was found as described above (position ② in FIG. 14A). Moreover, as a Young's modulus of the present titanium alloy member, it is thought of introducing the above-described mean Young's modulus.

Note that, in FIG. 14A and FIG. 14B, "σt" is the tensile strength, "εe" is the strain at the tensile elastic limit strength (σe) of the titanium alloy member according to the present invention, and "εp" is the strain at the 0.2% proof stress (σp) of the conventional metallic material.

③ As described above, it has not been clear at present why a titanium alloy member according to the present invention reveals such unordinary and good characteristics. In any case, according to the strenuous investigations and studies carried out by present the inventors, it is possible to believe as follows.

The present inventors investigated into a sample of a titanium alloy member according to the present invention. As a result, it was made clear that, when the titanium alloy member is subjected to cold working, as described above, the dislocation was hardly introduced into it, and it exhibited a structure whose (110) plane was strongly oriented in a part of directions. In addition, when it is observed with a TEM (Transmission Electron Microscope), in a dark field image using the 111 diffraction point, the contrast of the image was observed to move together with the inclination of the sample. This suggests that the observed (111) plane was curved greatly, and this was observed by a high-magnification lattice-image direct observation as well. In addition, the curvature radius of the curve in this (111) plane was extremely small to such an extent that it fell in a range of from 500 to 600 nm. This designates that the present titanium alloy member has such a nature, which has not been known in the conventional metallic materials, that it relieves the influence of working not by the introduction of dislocation but by the curving of crystal plane.

Moreover, the dislocation was observed, in a state in which the 110 diffraction point was strongly excited, in an extremely confined part, however, it was hardly observed when the excitation of the 110 diffraction point was canceled. This shows that the displacement components around the dislocation are remarkably deviated in the <110> direction, and suggests that the titanium alloy member according to the present invention has a very strong elastic anisotropy. It is believed that this anisotropy closely relates to the revelation, etc., of the good cold working property, low Young's modulus, high elastic deformation capability and high strength of the present titanium alloy member.

④ Thus, in accordance with a titanium alloy member according to the present invention, by suitably selecting compositions, heat treatments, and so on, it is possible to make the Young's modulus 70 GPa or less, 65 GPa or less, 60 GPa or less and further 55 GPa or less. Moreover, it is possible to make the tensile elastic limit strength 750 MPa or more, 800 MPa or more, 850 MPa or more, 900 MPa or more, 1,000 MPa or more, 1,400 MPa or more, 1,500 MPa or more and further 2,000 MPa or more.

(6) Usage

A titanium alloy member according to the present invention can be applied, by utilizing the good working property, low Young's modulus, high strength, anisotropy, etc., and further by combining the lightweightness, corrosion resistance, etc., to a various kind of products in a various kind of forms.

For instance, it is effective for products in automobiles, accessories, sports and leisure articles, medical apparatuses, etc., parts of the products, raw materials thereof (wire materials, plate materials, etc.), and the like. Specifically, it constitutes all or a part of the following products, or is used as raw materials for such products.

For example, they are golf clubs (in particular, face parts and shaft parts of drivers), articles related to living bodies (artificial bones, artificial joints, etc.), catheters, portable articles (glasses, clocks (wristwatches), barretters (hair accessories), necklaces, bracelets, earrings, pierces, rings, tiepins, brooches, cuff links, belts with buckles, lighters, fountain pens, key rings, keys, ball point pens, mechanical pencils, etc.), portable information terminals (cellular phones, portable recorders, cases, etc., of mobile personal computers, etc., and the like), coil springs for suspensions or engine valves, power transmission belts (hoops, etc., of CVT), and so on.

B. EXAMPLE

Hereinafter, examples and a comparative example are shown, and the present invention will be described specifically.

EXAMPLE

By using the production process according to the present invention, the latter-described respective samples concerning with this example were manufactured.

(1) Sintered Member (Sample Nos. 1 Through 10)

As raw materials, a commercially available hydrogenated-and-dehydrogenated Ti powder (-#325, -#100), and an Nb powder (-#325), a Ta powder (-#325), a V powder (-#325), an Hf powder (-#325) and a Zr powder (-#325), which were substitutional elements, were utilized. Oxygen, which was an interstitial element, was prepared from the aforementioned Ti powder, which included oxygen, or a high-oxygen-content Ti powder, into which oxygen was included by thermally treating the aforementioned Ti powder. In any case, since it was not easy to control the oxygen content, unless the oxygen content was intentionally adjusted, O could be mingled in titanium alloy to such an amount of from 0.15 to 0.20% by weight as an inevitable impurity. Incidentally, a high-oxygen-content Ti powder could be obtained by heating the aforementioned Ti powder in air at from 200° C. to 400° C. for from 30 minutes to 128 hours.

These raw materials were suitably selected, and were compounded and mixed so as to satisfy the aforementioned parameters "Md" and "Bo," mixture powders, which were composed of a variety of compositions responding to the desired respective samples, were prepared (a powder preparing step). The specific compositions of the respective samples will be described later. Note that, in mixing the respective raw material powders, a type "V" mixer was used, however, a ball mill, a vibration mill, a high-energy ball mill, and the like, can be used.

These raw material powders were subjected to a CIP forming (Cold Isostatic Press) at a pressure of 4 ton/cm$^2$, and thereby formed substances were obtained (a forming step). The obtained formed substances were heated to sinter in a vacuum of $1\times10^{-5}$ torr at 1,300° C. for 16 hours, and thereby sintered members (titanium alloy ingots) were made (a sintering step or member forming step).

① Cold-Swaged Member (Sample Nos. 1 and 4 through 10)

The titanium alloy ingots of ϕ55 mm, which were manufactured by the above-described sintering process, were worked to ϕ15 mm by hot working (a hot working step). They were worked to ϕ4 mm by cold swaging (a first cold working step), and strain-removing annealing was carried out at 900° C. (an annealing treatment step). The thus obtained ϕ4 mm workpieces were worked by cold swaging so as to be desired cold working ratios (a second cold working step).

Hereinafter, for the respective samples, the compositions and cold working ratios will be explained.

(a) Sample Nos. 1 and 4

Sample No. 1 (Ti-30Nb-10Ta-5Zr-0.4O (Oxygen of 0.4% by weight): The rates are % by weight, and are likewise designated hereinafter.) and Sample No. 4 (Ti-35Nb-2.5Ta-7.5Zr-0.4O) were made by further cold working the aforementioned workpieces from ϕ4 mm to ϕ2 mm. The cold working ratio of both of the samples was made 75%.

(b) Sample No. 5

Sample No. 5 (Ti-35Nb-9Zr-0.4O) was made by further cold working the aforementioned workpiece from ϕ4 mm to ϕ2.83 mm. The cold working ratio of this sample was made 50%.

(c) Sample Nos. 6-1 Through 6-5

Sample Nos. 6-1 through 6-5 (Ti-12Nb-30Ta-7Zr-2V-xO: The "x" was a variable.), which differed from each other in terms of the oxygen content only, were made by further cold working the aforementioned workpiece from ϕ4 mm to ϕ1.26 mm. The cold working ratio of the respective samples was made 90%. Note that the oxygen contents of the respective samples are set forth in Table 2.

(d) Sample Nos. 7 Through 10

Sample Nos. 7 through 10 differed from each other in terms of the composition, but were common in that they were made by further cold working the aforementioned workpiece from ϕ4 mm to ϕ1.79 mm. The cold working ratio of the respective samples was made 80%.

The compositions of the respective samples were made as follows: Sample No. 7 (Ti-28Nb-12Ta-2Zr-4Hf-0.8O), Sample No. 8 (Ti-17Nb-23Ta-8Hf-0.53O), Sample No. 9 (Ti-14Nb-29Ta-5Zr-2V-3Hf-1O) and Sample No. 10 (Ti-30Nb-14.5Ta-3Hf-1.2O).

② Cold-Rolled Member (Sample Nos. 2 and 3)

A titanium alloy ingot (4 mm in thickness) whose composition was the same as that of Sample No. 1 was cold-rolled, thereby obtaining a plate member having a thickness of 0.9 mm (Sample No. 2) and a plate member having a thickness of 0.4 mm (Sample No. 3) (a cold working step). The respective cold working ratios were made 94% and 97.3%.

The cold working in this instance was carried but, without intermediate annealing, by using a cold rolling machine. Specifically, in the case of Sample No. 2, the workpiece was passed through a 0.5 mm-pass until it had a plate thickness of 0.9 mm. Sample No. 3 was made by further working the plate member until it had a plate thickness of 0.4 mm while adjusting if the pass.

(2) Ingot Member (Sample Nos. 11 and 12)

As a raw material, a commercially available granular sponge titanium (the particle diameter being 3 mm or less) was used. As raw materials for substitutional elements, raw materials were used which were made by mixing an Nb powder (-#325), a Ta powder (-#325), a V powder (-#325) and a Zr powder (-#325), forming the resulting mixture powders with a mold at a pressure of 2 ton/cm$^2$ and pulverizing these to granules having a particle diameter of 3 mm. In this instance, the compositions of the substitutional elements were adjusted, based on desired samples, by compounding and mixing the aforementioned raw material powders so as to satisfy the above-described parameters "Md" and "Bo."

The thus obtained respective granular raw materials were mixed with predetermined ratios uniformly, were melted by an induction scull method, were held at 1,800° C. for 20 minutes, and were thereafter made into ingots by casting with a mold (a member forming step, an ingot manufacturing step or melting and casting step).

Here, the substitutional component raw materials were manufactured from powder-formed substances, because the respective melting points of the substitutional elements were extremely high, and because they are likely to cause segregation, so that the quality degradations of the titanium alloy members, which resulted therefrom, could be avoided as much as possible. Note that oxygen being an interstitial element was prepared by O included in the aforementioned sponge titanium.

The ϕ55 mm×200 mm mold-cast ingots, which were manufactured by this melting process, were made to ϕ15 mm by hot working at 1,000° C. (a hot working step). After they were made to ϕ4 mm by cold swaging (a first cold working step), strain-removing annealing was carried out at 900° C. (an annealing treatment step). The thus obtained ϕ4 mm workpieces were made to ϕ1.26 mm by further cold working (a second cold working step). In this case, the cold working ratio was made 90%.

Thus, Sample Nos. 11 and 12, which were ingot members, were manufactured. Sample No. 11 and Sample No. 12 were the same as aforementioned Sample No. 6 in terms of the interstitial alloying components, and differed from each other only in terms of the oxygen contents (Ti-12Nb-30Ta-7Zr-2V-xO: The "x" was a variable.). The oxygen contents of the respective samples are set forth in Table 2.

(3) Age-Treated Members (Sample Nos. 13 and 14)

To the test piece same as that of Sample No. 6-3, an age-treatment was further performed, and thereby Sample Nos. 13 and 14 were manufactured.

Sample No. 13 was one which was subjected to an age-treatment at 250° C. for 30 minutes (the parameter "P"=10.3) after the second cold working step in Sample No. 6-3.

Sample No. 14 was one which was subjected to an age-treatment at 400° C. for 24 hours (the parameter "P"= 14.4) after the second cold working step in Sample No. 6-3.

COMPARATIVE EXAMPLE

As a comparative example, a cold-swaged material (Trade Name: DAT51) whose composition was Ti-22V-4Al (% by weight) was prepared. A round bar (ϕ150 mm) of this titanium alloy was worked by hot working to ϕ6 mm. Thereafter, by cold swaging, it was finally turned into a ϕ4 mm wire material, and made a comparative sample.

MEASUREMENTS

Crystal Structure

Figure 2:
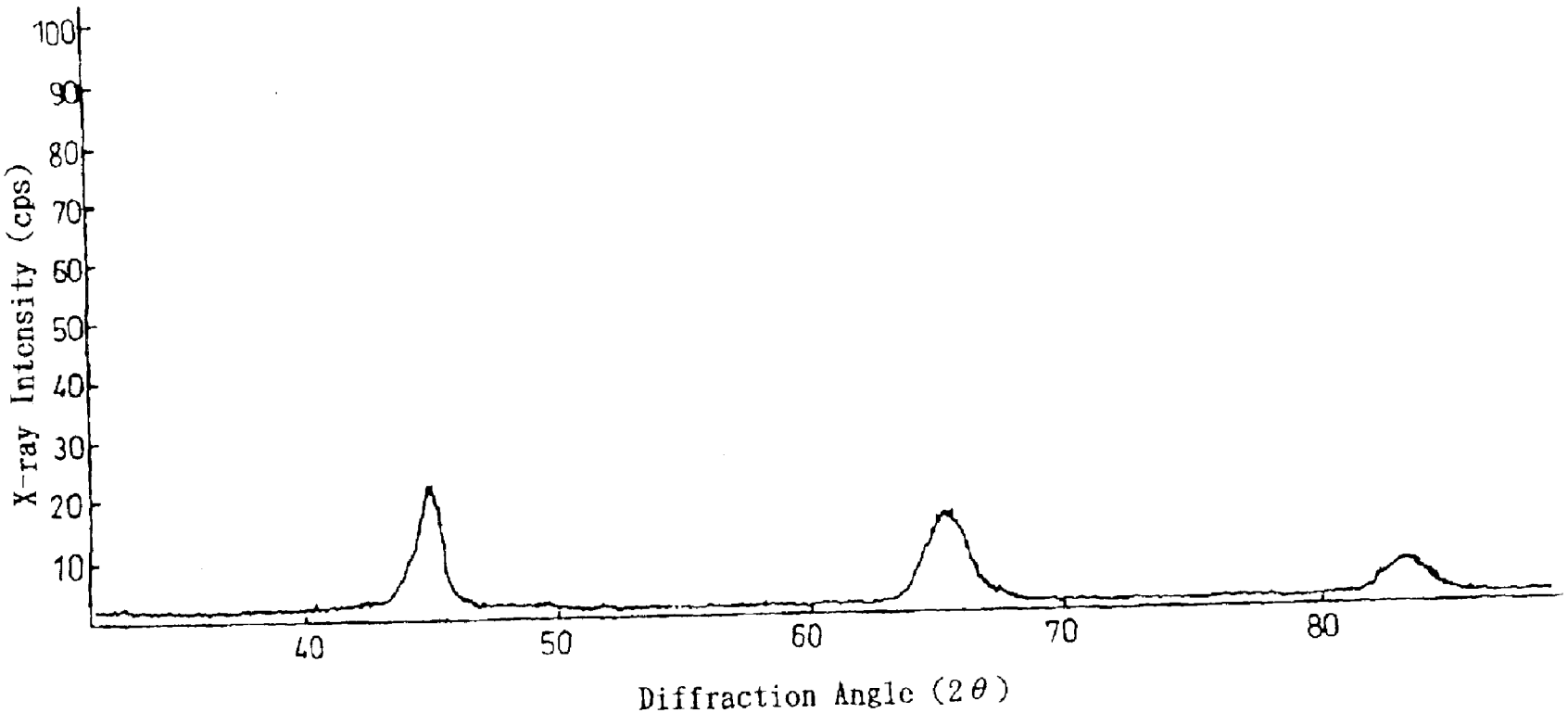
FIG. 2 is a diagram for illustrating the x-ray diffraction results of Sample No. 2 concerning with an example.

The crystal structures of Sample Nos. 1 through 12 were measured by the ordinary θ–2θ method by using a rotary paired cathode type x-ray diffraction apparatus under the conditions that a CoK α-ray of 40 kV and 70 mA and a monochromater was added. As a representative example, the result in Sample No. 2 is illustrated in FIG. 2.

In all of the samples, 3 diffraction lines were confirmed, as a result of the diffraction, this crystal structure was understood to be a body-centered cubic crystal. However, strictly speaking, in the case like FIG. 2, there is a possibility of being a body-centered tetragonal crystal, however, it is difficult to precisely distinguish between them, and there is no need to do so.

(2) Texture

Regarding the textures of Sample Nos. 1 through 12 as well as the comparative example, the polar figures were measured by using the above-described Schlutz's reflection method. The measurement conditions in this instance are set forth in Table 1.

TABLE 1

Measurement Conditions for Polar Figures

| | | |
|---|---|---|
| Used X-ray | CoKα ray (40 kV, 70 mA) | |
| Measurement Method | Schlutz's Reflection Method | |
| Slit | Diverging Slit (DS) | ½° |
| | Scattering Slit (SS) | 2° (Provided with Fe Filter) |
| | Receptor Slit (RS) | 4 mm |
| | Schlutz Slit | Provided |
| Measurement Range | α' (See FIG. 1.) | 20°–90° (for Every 5°) |
| | β (See FIG. 1.) | 0°–360° (for Every 5°) |

However, in order to be measurable with ease, the forms, etc., of the respective samples were adjusted in the following manner.

(a) In Sample Nos. 1 and 4 through 12, 6 pieces of the wire materials were cut to about 15 mm, were aligned in the same direction with regard to the working direction, were embedded in a resin, and were grounded until the cross-sectional areas became maximum, thereby making samples for the measurement.

The diffraction angle of the (110) diffraction reflection used in this instance was 2θ=44.9° (Sample Nos. 1 and 4) or 2θ=44.7° (Sample No. 5), and the diffraction angle of the portion, which was made into the background, was 2θ=49.0° in all of them.

Figure 3:
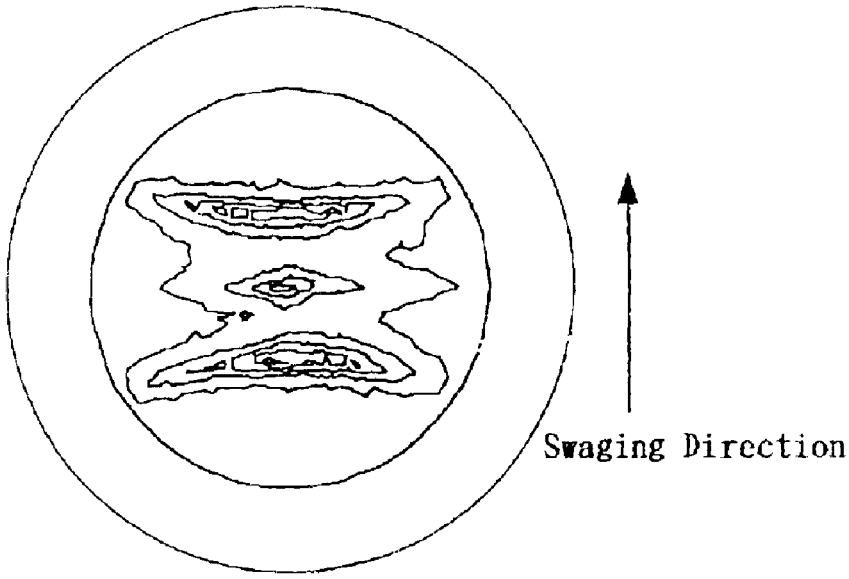
FIG. 3 is a polar figure of Sample No. 1 concerning with an example.
Figure 4:
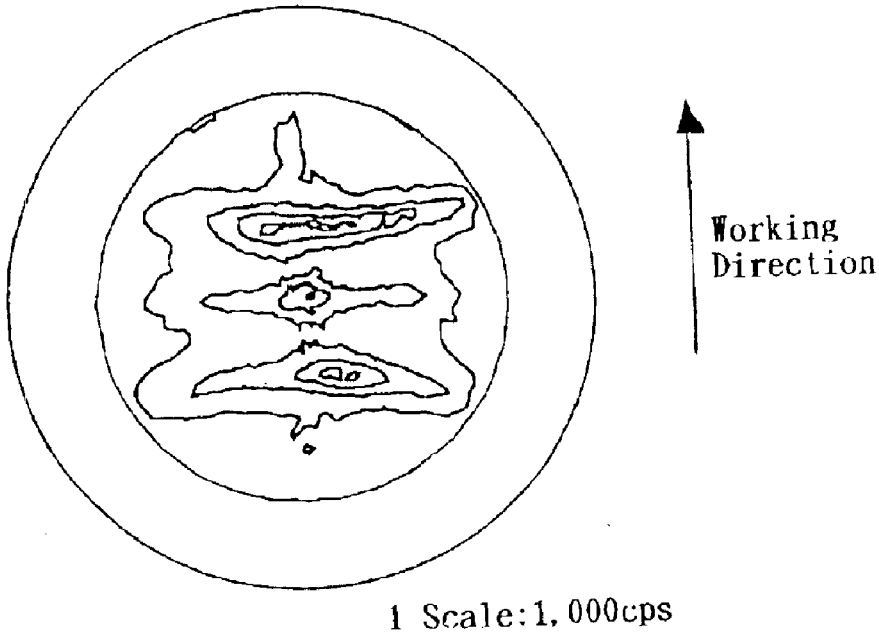
FIG. 4 is a polar figure of Sample No. 4 concerning with an example.
Figure 5:
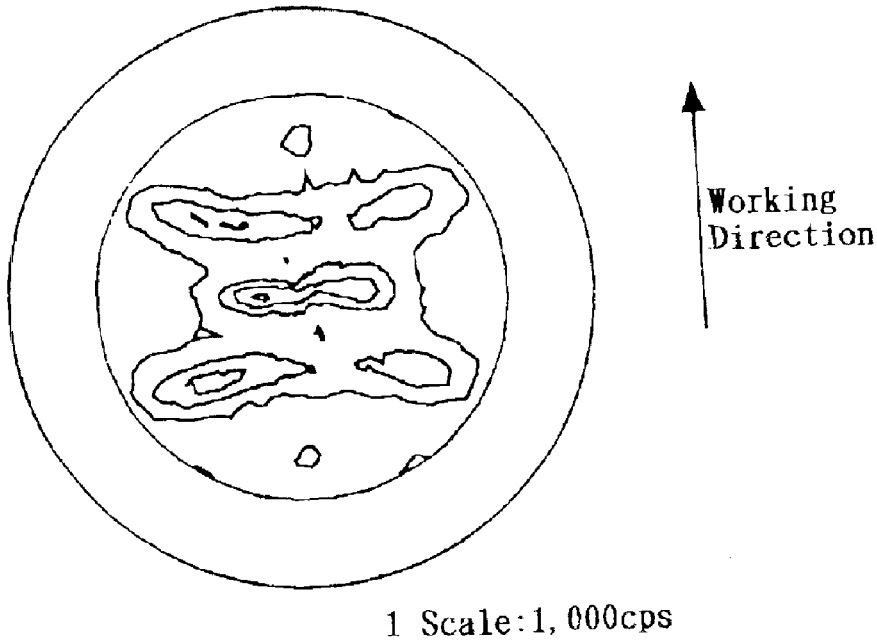
FIG. 5 is a polar figure of Sample No. 5 concerning with an example.

In this instance, the (110) polar figure of Sample No. 1 is illustrated in FIG. 3, the (110) polar figure of Sample No. 4 is illustrated in FIG. 4, and the (110) polar figure of Sample No. 5 is illustrated in FIG. 5, respectively.

Note that, in the same drawings, for instance, the designation "1 Scale: 1,000 cps" designates that one part of the intervals between the contours corresponds to 1,000 cps of the x-ray diffraction intensity (In a case of 500 cps as well, it is the same hereinafter.).

(b) In Sample No. 2 and Sample No. 3, the respective plate members were cut out to a disk shape of about ϕ26 mm by electrical discharge machining, thereby making samples for the measurement.

Their measurement conditions, the diffraction angle of the (110) diffraction reflection and the diffraction angle of the portion, which was made into the background, were the same as the aforementioned case.

Figure 6:
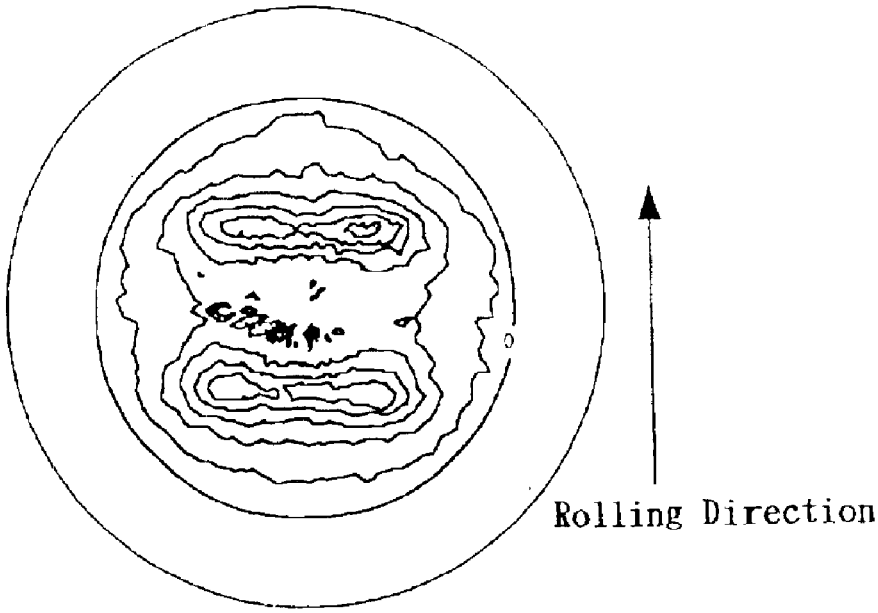
FIG. 6 is a polar figure of Sample No. 2 concerning with an example.
Figure 7:
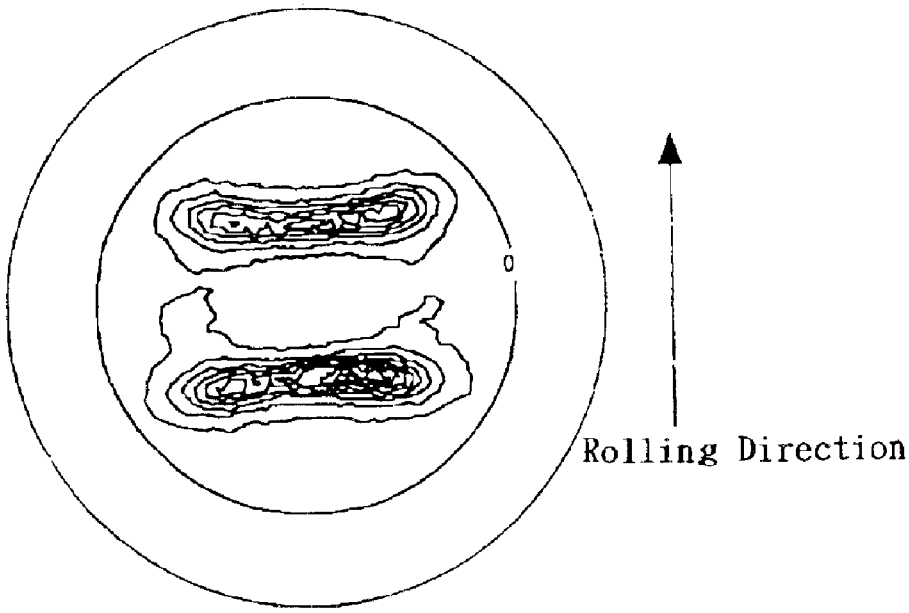
FIG. 7 is a polar figure of Sample No. 3 concerning with an example.

In this instance, the (110) polar figure of Sample No. 2 is illustrated in FIG. 6, and the (110) polar figure of Sample No. 3 is illustrated in FIG. 7.

(c) In the comparative example, 4 pieces of the wire material, which were cut in the working direction, were embedded in a resin similarly to Sample No. 1, and so on, and were grounded until the cross-sectional areas became maximum, thereby making samples for the measurement.

The diffraction angle of the (110) diffraction reflection used in this instance was 2θ=46.2°, and the diffraction angle of the portion, which was made into the background, was 2θ=49.0°.

Figure 8:
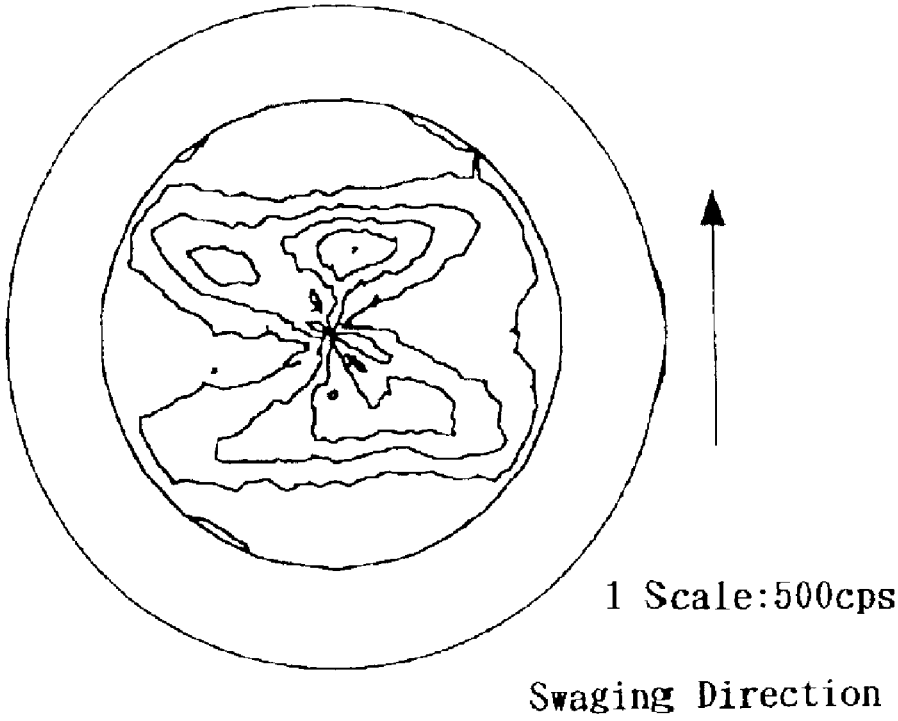
FIG. 8 is a polar figure of a comparative sample.

In this instance, the (110) polar figure is illustrated in FIG. 8A.

② Next, in order to objectively and quantitatively evaluate the distributions (extents of scattering) of the measurement values (X), which were obtained for the respective samples by this measurement, statistical processing was performed for the respective samples, thereby calculating the secondary moments (ν2) and tertiary moments (ν3) around the mean values (Xm). The definitions of them are as described above.

However, in a case where the statistical processing is carried out onto those measurement values, such a premise is needed that the respective measurement values are equivalent on the polar figure. In the present examples, since the measurement is carried out while moving the α' and β, respectively, by 5° by an equal angle as set forth in Table 1, the measurement points are not distributed equally on the polar figure. Hence, in order to correct this and make the respective measurement points equivalent, a weighting function "W" was introduced so that the above-described respective equations were multiplied by the "W" instead of (1/N) in the above-described respective equations. Of course, when measurement points on a polar figure are distributed equally, the "W" is always a constant value so that it can be rewritten to W=w/(Nw)=1/N, and the weighting function "W" equals "1/N."

Figure 9:
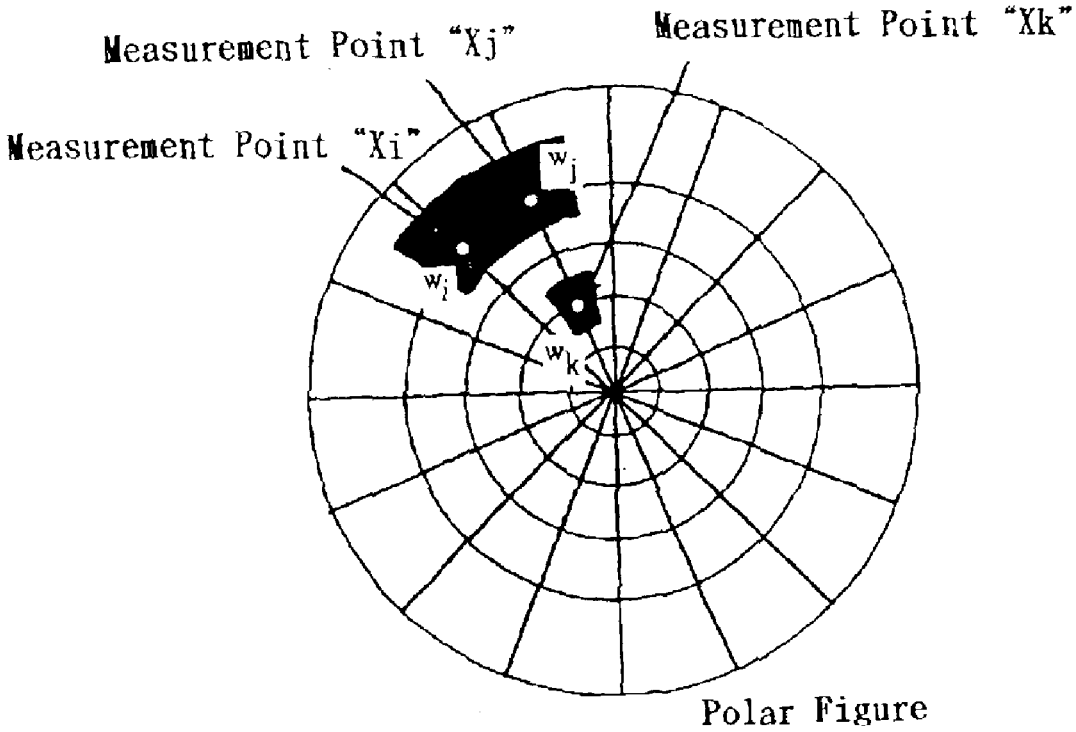
FIG. 9 is an explanatory diagram with regard to the definition of a weighting function "W."

This weighting function "W" is defined by using an area "w," which a measurement point (for example, "$w_i$," "$w_j$" and "$w_k$") designated in FIG. 9 shows in a polar figure, as set forth in the following equations. These equations are set forth collectively.

| | |
|---|---|
| Mean Value: | $Xm = \Sigma WX$ |
| Secondary Moment around Mean Value (Xm): | $\nu 2 = \Sigma W(X - Xm)^2$ |
| Tertiary Moment around Mean Value (Xm): | $\nu 3 = \Sigma W(X - Xm)^3$ |
| Weighting Function: | $W = w/(\Sigma w)$ |

Note that, in order to make the comparison between different samples easier, it was decided to find the values by dividing the aforementioned secondary moment (ν2) and tertiary moment (ν3) with the square ($Xm^2$) of the mean value and the cubic ($Xm^3$) of the mean value, respectively.

Moreover, it is ideal that a range of the sum (Σ) be found with the entire area on a polar figure, however, in a case of a wire material like Sample No. 1, it is very difficult to carry out such a measurement of the polar figure. Accordingly, the measurement range set forth in Table 1 was considered the range of the sum (20°<α'<90° and 0°<β<360°).

The thus obtained results on the respective samples are set forth in Table 2.

③ Moreover, for the respective samples, maximum ones (maximum values) in the measurement values which were measured in a range of 55°<α'<65° and in the range of β along the working direction are set forth in Table 2 together therewith. However, note that, in Table 2, they are designated by magnifications based on the mean values (Xm).

(3) Dislocation Density, Etc.

① In order to carry out a TEM (Transmission Electron Microscope) observation on Sample No. 1, a thin film for observation was formed by using an FIB (Focused Ion Beam) apparatus or an ion milling apparatus.

Figure 10:
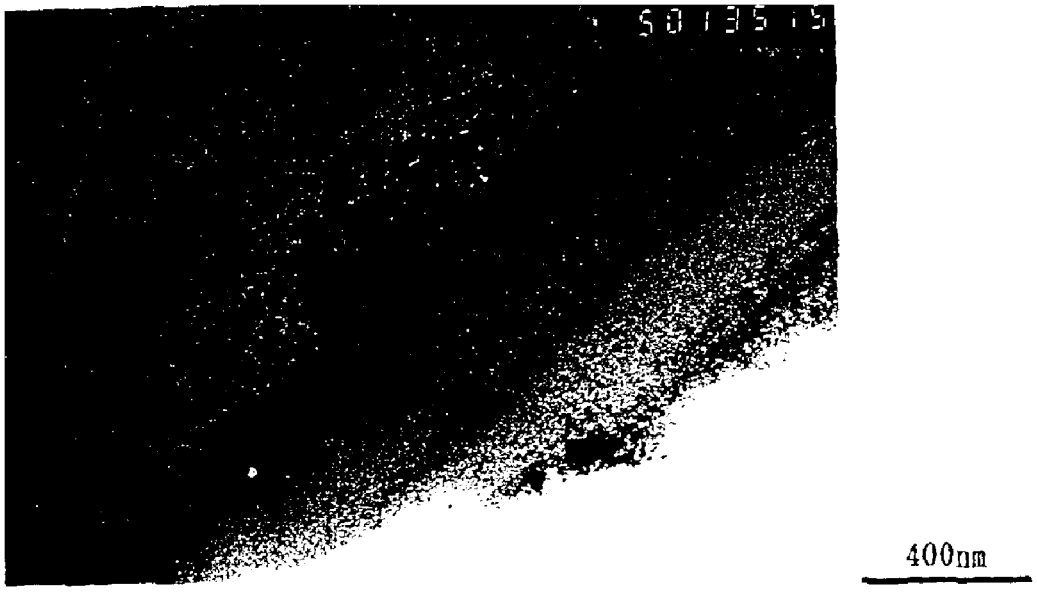
FIG. 10 is a TEM (bright field image) photograph for illustrating the metallic structure of Sample No. 1 concerning with an example.

A photograph (bright field image), in which the metallic structure inside the grains was observed by the TEM, is shown in FIG. 10. From the photograph shown in FIG. 10, a dislocation, which could be apparently recognized as a linear defect, was not observed at all. In addition, when the grains were observed by a diffraction contrast method, there was no dislocation which was clearly confirmed.

Figure 11:
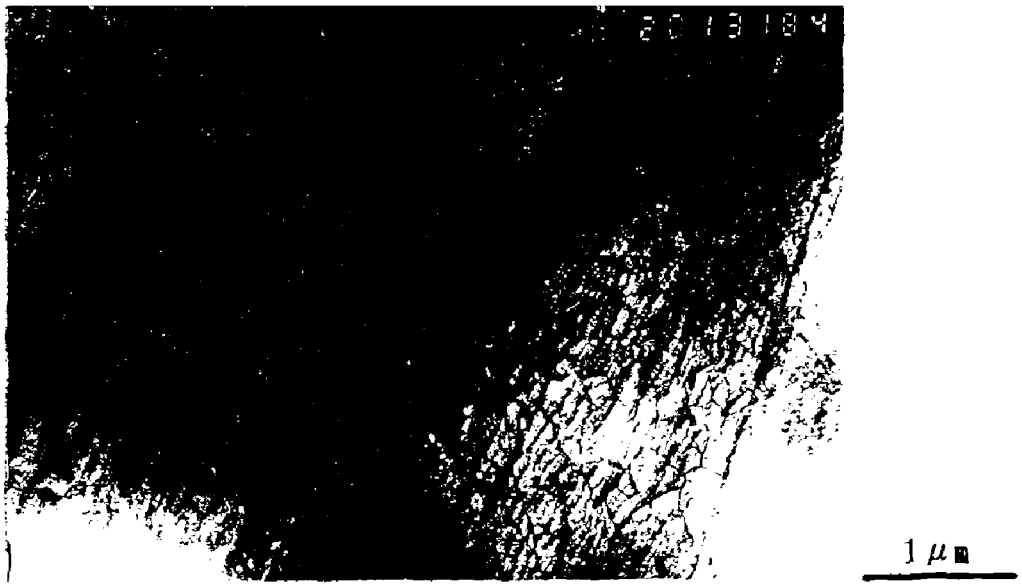
FIG. 11 is a TEM (bright field image) photograph for illustrating the metallic structure of Sample No. 1' concerning with an example.

Moreover, on a sample (Sample No. 1') which was manufactured in the middle stage of working Sample No. 1, a photograph (bright field image), in which the metallic structure inside the grains was observed by the TEM, is shown in FIG. 11. This Sample No. 1' was one which was made by working a ϕ55 mm ingot to ϕ15 mm by hot swaging.

In the photograph shown in this FIG. 11, dislocations were observed in the metallic structure. When the dislocation density in this instance was roughly calculated under the following conditions, it was $10^{10}/cm^2$ approximately. Therefore, it is possible to believe that the dislocation density was $10^{11}/cm^2$ or less at most.

| | |
|---|---|
| Observation Range: | Length (3 μm) × Width (4 μm) × Sample Film Thickness (0.07 μm) |
| Dislocation Line Total Extension: | 3 μm × 24 Lines |

Figure 12:
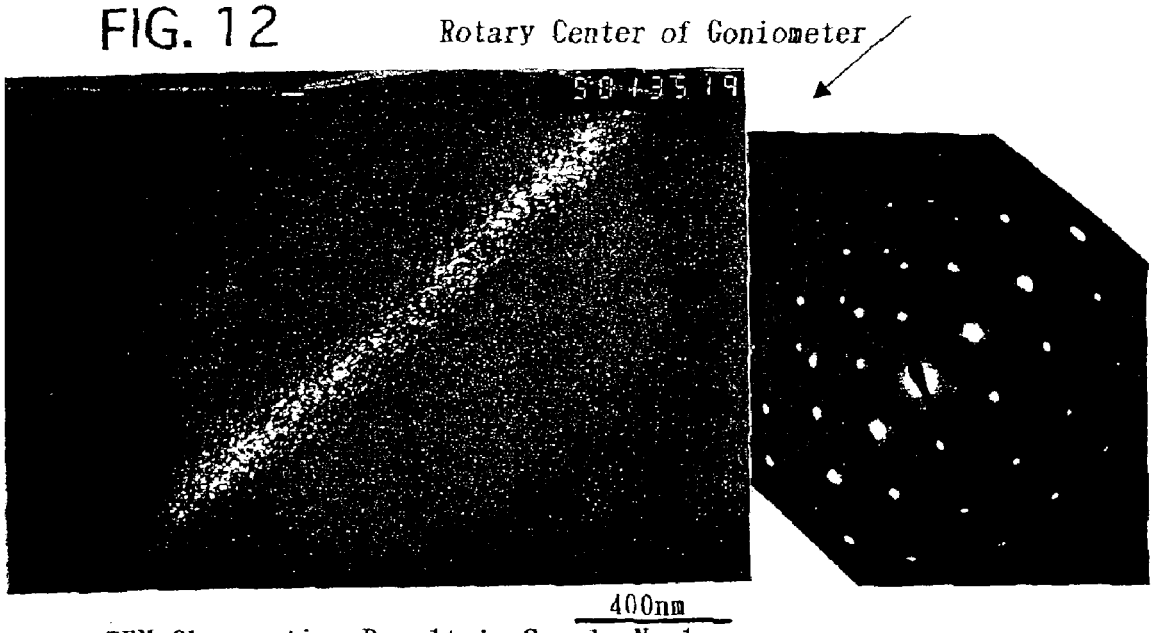
FIG. 12 is a TEM (dark field image: −16.3°) photograph for illustrating the metallic structure of Sample No. 1 concerning with an example.
Figure 13:
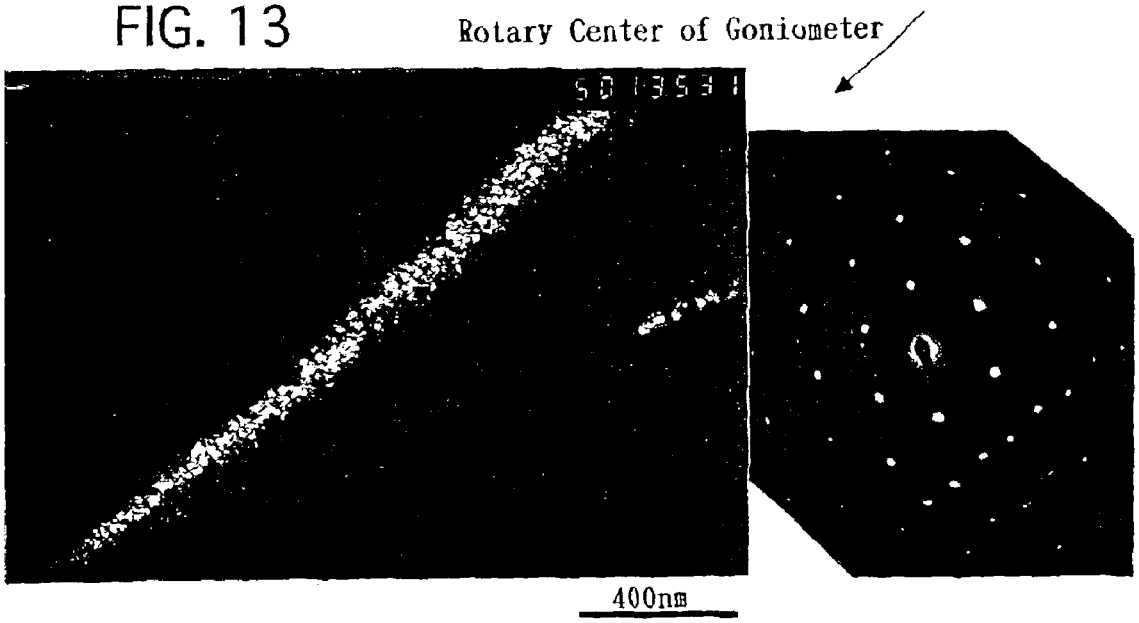
FIG. 13 is a TEM (dark field image: 6.1°) photograph for illustrating the metallic structure of Sample No. 1 concerning with an example.

② Moreover, metallic structure photographs of dark images, which were observed on above-described Sample No. 1 with the TEM, are shown in FIG. 12 and FIG. 13. Both of these photographs are ones in which the identical place was observed, however, they were observed with an inclination angle to an extent of about 20° with each other by inclining the sample.

In both of them, the electron diffraction patterns show the (111) plane. However, in the dark field images in which the (110) diffraction point was used, it is understood that the glittering portions were moved by an extent of 200 nm. This suggests that the observed (111) plane was curved, when calculating from both of the photographs, the curvature radius was to an extent of from 500 to 600 nm.

③ Similarly, when the dislocation density was found for the comparative sample being the comparative example, it became $10^{15}/cm^2$ or more.

(4) Others

① Energy Level "Md" of d-Electron Orbit and Bond Order "Bo"

On the respective samples, by the DV-Xα cluster method, the compositional mean values of the energy level "Md" of the d-electron orbit and the compositional mean values of the bond order "Bo" were calculated. The results are set forth in Table 2 and Table 3.

② Mechanical Characteristics

On the respective samples, the mechanical characteristics, such as the mean Young's modulus, the tensile strength, and so on, were found. The results are set forth in Table 2 and Table 3 together therewith.

These mechanical characteristics were found from stress-strain diagrams by measuring relationships between loads and strains with an Instron testing machine. The Instron testing machine is a universal tensile testing machine, which is made by Instron (a name of the maker), and its driving system is controlled by an electric motor.

EVALUATION AND EXAMINATION (1) On Polar Figures

When the polar figures (FIGS. 3 through 7) of Sample Nos. 1 through 5 according to the titanium alloy member of the present invention are contrasted and compared with the polar figure (FIG. 8) of the comparative sample, the following are understood.

① Concerning Sample Nos. 1 through 5, it is understood the (110) plane is strongly oriented in a part of directions. Namely, it is assumed that the titanium alloy members had a strong elastic anisotropy.

For instance, when viewing FIG. 3, with respect to the measurement plane as a whole, the deviation of the measurement values is very large, besides the measurement values protrude at certain portions. The protrusions show that the (110) plane or (101) plane was concentrated at around α'=60° along the working direction, namely in the direction inclined by 30° from the normal-line direction of the sample.

This strong orientation of the (110) plane or (101) plane can be interpreted to reflect the strong elastic anisotropy of Sample No. 1. As a result of cold working the material having such a high anisotropy, it is believed that, in Sample No. 1, a crystal plane exhibiting a very high rigidity (high rigidity crystal plane) matched so as to align a cylinder-shaped outer configuration and made a titanium alloy member which was flexible to bending deformation and exhibited a high strength in the longitudinal direction.

Moreover, when comparing the polar figures (FIG. 6 and FIG. 7) of Sample No. 2 and Sample No. 3, it is understood that the more the working ratio enlarged the more the deviation of the measurement values enlarged in the polar figure. Namely, it suggests that, similarly to the above-described one, the more the working ratio enlarges the more the high rigidity crystal plane orients in the specific direction, and it is believed that the special merits, being flexible and exhibiting a high strength, of the titanium alloy member according to the present are strongly revealed.

Then, the titanium alloy member, exhibiting such a strong anisotropy, has the high rigidity crystal plane, while it has a low rigidity crystal plane which deforms with ease, due to the presence of this crystal plane which deforms with ease, it is believed that a good working property is obtained.

Note that, at the present stage, these examinations are mere assumptions only, and it is notified herein that it has not been clear yet on the details.

② While, when viewing the polar figure (FIG. 8) of the comparative sample, it is understood that the deviation of the measurement values was relatively gentle, and it is believe that the elastic anisotropy was smaller than those of the titanium alloy members of the present invention.

(2) $\nu 2/Xm^2$ and $\nu 3/Xm^3$

The $\nu 2/Xm^2$ shows that the larger the value is the larger the deviation of the measurement values (X) is. Moreover, the $\nu 3/Xm^3$ shows that the larger it is in a range of positive number the more the measurement values (X) distribute in the portions which protrude greatly beyond the mean value (Xm).

① When inspecting Sample Nos. 1 through 12, both of the $\nu 2/Xm^2$ and $\nu 3/Xm^3$ showed relatively large values. This is because the deviation of the measurement values is large with respect to the measurement plane as a whole in the polar figure, and shows that the (110) crystal plane of the titanium alloy members of the present invention is strongly oriented in the specific direction. Thus, by using the $\nu 2/Xm^2$ and $\nu 3/Xm^3$, it is possible to objectively as well as quantitatively evaluate the extent of the orientation in textures.

It is the same as described on the polar figures, when comparing Sample No. 2 and Sample No. 3, it is understood that, in the titanium alloy members of the present invention, the more the cold working ratio enlarged the more the $\nu 2/Xm^2$ and $\nu 3/Xm^3$ enlarged, and that the (110) crystal plane was strongly oriented in the specific direction.

② When inspecting the comparative sample, the $\nu 3/Xm^3$ was relatively small. This shows that the protrusions of the measurement values at specific positions were small, and it is thought that, compared with Sample No. 1, and so on, the extent of the orientation in the texture was small.

(3) On Metallic Structure Photographs

① The curving of the (111) plane, which is observed by the metallic structure photographs shown in FIGS. 12 and 13, has been already referred to, even in a high resolution observation, a slightly curved crystal plane was observed.

Thus, it is believed that the titanium alloy member of the present invention may probably relieve the influence of working by the curving of crystal plane without the introduction of dislocation, and may thereby improve the (cold) working property.

② Moreover, in the metallic structure photograph shown in FIG. 11, the dislocation was observed in a state in which the 110 diffraction point was strongly excited, however, it was hardly observed when the excitation at the 110 diffraction point was canceled.

This shows that the displacement components around the dislocation shown in FIG. 11 were remarkably deviated in the <110> direction, it can be said that this is the appearance of the very strong anisotropy of the present titanium alloy member.

It is believed that such characteristics are the generation sources of the curving of crystal plane described above and eventually the rubber-like working property. In any case, the details have not been cleared yet.

(4) Others

① Energy Level "Md" of d-Electron orbit and Bond Order "Bo"

In the titanium alloy members of Sample Nos. 1 through 4, all of them exhibited the "Md" and "Bo" falling in ranges of from 2.43<Md<2.49 and 2.86<Bo<2.90, and it is understood that a compatibility between a favorable cold working property and a low Young's modulus was established.

② Mechanical Characteristics

It is understood that, when comparing Sample No. 1, and so on, with the comparative sample, the titanium alloy members of the present invention exhibited remarkably lower Young's moduli, and, in addition thereto, it exhibited sufficiently if larger tensile strengths. Moreover, it, is understood from Sample Nos. 13, 14, etc., that they demonstrated good tensile elastic limit strengths and elastic elongations. Therefore, the titanium alloy member of the present invention is provided with a remarkable elastic deformation capability (to an extent of 2.5% approximately). On the other hand, the elastic deformation capability of the comparative example was to an extent of 1% at most, and was insufficient.

③ Finally, the working property of the titanium alloy member of the present invention and that of the conventional titanium alloy member are investigated.

The conventional titanium alloy member (DAT51) exhibited the less degradation in terms of the drawing property after cold working, however, when the cold working ratio fell in a range of from 10 to 15%, there arose the sharp decline in terms of the elongation. It is believed that this is caused by the increment of the dislocation density (the dislocation density of $10^{15}/cm^2$ or more).

While, in the titanium alloy member of the present invention, even when the cold working ratio was 99% or more, there were not the sharp decline, and the like, in terms of the elongation, and the cold working property was very good.

Thus, the titanium alloy member of the present invention has the characteristics, such as being good in terms of the working property, being flexible and exhibiting a high strength, which have not been available in the conventional materials. By utilizing those respective characteristics independently or synergistically, it is possible to expand its usages to immeasurable extent.

TABLE 2

| | | Texture | | | C. of I. E. *1 | | *2 | *3 | *4 | |
|---|---|---|---|---|---|---|---|---|---|---|
| | Sample # | $\nu 2/Xm^2$ | $\nu 3/Xm^3$ | *5 (× Xm) | *6 "Md" | *7 "Bo" | (GPa) | (MPa) | (%) | Remarks |
| Ex. | 1 | 0.593 | 0.940 | 4.310 | 2.462 | 2.876 | 46 | 1,150 | 75 | |
| | 2 | 0.481 | 0.342 | 2.810 | 2.462 | 2.876 | 43 | 1,150 | 94 | Same Composition as Sample No. 1 |

TABLE 2-continued

| | | Texture | | | C. of I. E. *1 | | *2 | *3 | *4 | |
|---|---|---|---|---|---|---|---|---|---|---|
| | Sample # | $\nu 2/Xm^2$ | $\nu 3/Xm^3$ | *5 (× Xm) | *6 "Md" | *7 "Bo" | (GPa) | (MPa) | (%) | Remarks |
| | 3 | 1.632 | 4.835 | 5.488 | 2.462 | 2.876 | 42 | 1,170 | 97.3 | Same Composition as Sample No. 1 |
| | 4 | 0.446 | 0.422 | 3.399 | 2.467 | 2.880 | 48 | 1,050 | 75 | |
| | 5 | 0.408 | 0.326 | 1.890 | 2.471 | 2.879 | 47 | 950 | 50 | |
| | 6–1 | 1.478 | 4.762 | 5.007 | 2.465 | 2.875 | 40 | 700 | 90 | O: 0.15 |
| | 6–2 | 1.339 | 3.872 | 4.673 | 2.465 | 2.875 | 40 | 1,080 | 90 | O: 0.25 |
| | 6–3 | 1.415 | 4.315 | 5.117 | 2.465 | 2.875 | 42 | 1,215 | 90 | O: 0.50 |
| | 6–4 | 1.365 | 5.172 | 5.313 | 2.465 | 2.875 | 44 | 1,400 | 90 | O: 0.65 |
| | 6–5 | 1.503 | 4.072 | 4.988 | 2.465 | 2.875 | 44 | 1,420 | 90 | O: 0.75 |
| | 7 | 0.512 | 0.853 | 3.379 | 2.460 | 2.875 | 48 | 1,378 | 80 | |
| | 6 | 1.316 | 4.027 | 5.573 | 2.468 | 2.870 | 46 | 1,165 | 80 | |
| | 9 | 0.473 | 0.498 | 3.015 | 2.463 | 2.879 | 52 | 1,420 | 80 | |
| | 10 | 1.589 | 4.731 | 5.842 | 2.469 | 2.870 | 55 | 1,580 | 80 | |
| | 11 | 1.358 | 4.215 | 6.331 | 2.465 | 2.875 | 43 | 950 | 90 | O: 0.24, Ingot Member |
| | 12 | 1.526 | 3.913 | 5.786 | 2.465 | 2.875 | 46 | 1,120 | 90 | O: 0.46, Ingot Member |
| Comp. Ex. | | 0.480 | 0.289 | 3.238 | 2.485 | 2.968 | 80 | 900 | 55.5 | DAT51 |

Notes:
*1 stands for "Compositions of Interstitial Elements."
*2 stands for "Mean Young's Modulus."
*3 stands for "Tensile Strength."
*4 stands for "Working Ratio."
*5 stands for "Maximum Value."
*6 stands for "Energy Level of d-Electron Orbit."
*7 stands for "Bond Order."

TABLE 3

| | | C. of I. E. *1 | | *2 | *3 | *4 | *5 | |
|---|---|---|---|---|---|---|---|---|
| | Sample # | *6 "Md" | *7 "Bo" | (GPa) | (MPa) | (%) | (%) | Remarks |
| Ex. | 13 | 2.465 | 2.875 | 41 | 1,280 | 2.7 | 90 | Age-treatment (Low Temp.) |
| | 14 | 2.465 | 2.875 | 90 | 1,850 | 1.9 | 90 | Age-Treatment (High Temp.) |

Notes:
*1 stands for "Compositions of Interstitial Elements."
*2 stands for "Mean Young's Modulus."
*3 stands for "Tensile Elastic Limit Strength."
*4 stands for "Elastic Elongation."
*5 stands for "Working Ratio."
*6 stands for "Energy Level of d-Electron Orbit."
*7 stands for "Bond Order."

What is claimed is:

1. A titanium alloy member comprising

40% by weight or more of titanium (Ti), a IVa group element other than titanium as a first substitutional element, a Va group element as a second substitutional element, and 0.25 to 2.0% by weight of one or more interstitial elements selected from the group consisting of oxygen (O), nitrogen (N) and carbon (C), wherein the titanium alloy member contains a summed amount of the Va group element, the IVa group element other than titanium, and the titanium of 90% by weight or more;

the titanium alloy member has a composition in which a compositional mean value of the substitutional elements is 2.43<Md<2.49 with regard to the energy level "Md" of the d-electron orbit and a compositional mean value of the substitutional elements is 2.86<Bo<2.90 with regard to the bond order "Bo", where the "Md" and the "Bo" are each a parameter obtained by the "DV-Xα" cluster method;

the titanium alloy member is in a cold-worked condition;

the titanium alloy member comprises grains having a body-centered tetragonal or a body-centered cubic crystal structure, in which a ratio (c/a) of a distance between atoms on the c-axis with respect to a distance between atoms on the a-axis falls in a range of from 0.9 to 1.1;

the titanium alloy member has a texture such that, when a polar figure of the (110) or (101) crystal plane of the grains is measured parallel to a working direction, in ranges of 20°<α'<90° and 0°<β<360° by the Schulz reflection method, ($\nu 2/Xm^2$) is 0.3 or more, and ($\nu 3/Xm^3$) is 0.3 or more, where $$\nu 2=\{\Sigma(X-Xm)^2\}/N,$$

$$\nu 3=\{\Sigma(X-Xm)^3\}/N, \text{and}$$

Xm is the mean value of N measurement values X; and the titanium alloy member has a tensile deformation property such that a gradient of the tangential line in a stress-strain diagram obtained by a tensile test within an elastic deformation range, in which the stress ranges from 0 to the tensile elastic limit strength, decreases continuously with increase in stress.

2. The titanium alloy member set forth in claim 1, exhibiting a dislocation density of $10^{11}/cm^2$ or less when cold working is carried out by 50% or more.

3. The titanium alloy member set forth in claim 1, including the one or more interstitial elements in a summed amount of from 0.6 to 1.5% by weight.

4. A process for making a titanium alloy member, the process comprising:

preparing a raw material;

forming the raw material;

carrying out cold-working; and producing the titanium alloy member of claim 1.

5. The process set forth in claim 4, wherein the raw material comprises a powder; and the forming comprises sintering the raw material.

6. The process set forth in claim 4, further comprising manufacturing an ingot from the raw material.

7. The process set forth in claim 5, wherein in the cold-working a cold-working ratio is 10% or more; and the process further comprises age-treating the cold-worked material so that the Larson-Miller parameter P falls in a range of from 8.0 to 18.5 at a treatment temperature falling in a range of from 150° C. to 600° C.

8. The process set forth in claim 7, wherein

P falls in a range of from 8.0 to 12.0 and the treatment temperature falls in a range of from 150° C. to 300° C.; and the titanium alloy member obtained after the age-treating has a tensile elastic strength of 1,000 MPa or more, an elastic deformation capability of 2.0% or more and a mean Young's modulus of 75 GPa or less.

9. The process set forth in claim 7, wherein

P falls in a range of from 12.0 to 14.5 and the treatment temperature falls in a range of from 300° C. to 600° C.; and the titanium alloy member obtained after the age-treating has a tensile elastic strength of 1,400 MPa or more, an elastic deformation capability of 1.6% or more and a mean Young's modulus of 95 GPa or less.

10. The process set forth in claim 6, further comprising cold-working the ingot.

11. The process set forth in claim 10, wherein in the cold-working a cold-working ratio is 10% or more; and the process further comprises age-treating the cold-worked material so that the Larson-Miller parameter P falls in a range of from 8.0 to 18.5 at a treatment temperature falling in a range of from 150° C. to 600° C.

12. The process set forth in claim 11, wherein

P falls in a range of from 8.0 to 12.0 and the treatment temperature falls in a range of from 150° C. to 300° C.; and the titanium alloy member obtained after the age-treating has a tensile elastic strength of 1,000 MPa or more, an elastic deformation capability of 2.0% or more and a mean Young's modulus of 75 GPa or less.

13. The process set forth in claim 11, wherein

P falls in a range of from 12.0 to 14.5 and the treatment temperature falls in a range of from 300° C. to 600° C.; and the titanium alloy member obtained after the age-treating has a tensile elastic strength of 1,400 MPa or more, an elastic deformation capability of 1.6% or more and a mean Young's modulus of 95 GPa or less.

* * * * *

UNITED STATES PATENT AND TRADEMARK OFFICE

CERTIFICATE OF CORRECTION

PATENT NO. : 6,979,375 B2
DATED : December 27, 2005
INVENTOR(S) : Tadahiko Furuta et al.

It is certified that error appears in the above-identified patent and that said Letters Patent is hereby corrected as shown below:

Title page,
Item [57], ABSTRACT,
Line 1, "comprise" should read -- comprises --.

Signed and Sealed this

Thirteenth Day of June, 2006

JON W. DUDAS
*Director of the United States Patent and Trademark Office*